US005749713A

United States Patent [19]

Heylbroeck

[11] Patent Number: 5,749,713

[45] Date of Patent: May 12, 1998

[54] LIQUID FUEL BURNERS

[76] Inventor: Albert Heylbroeck, 5743 Auteuil, Brossard, Quebec, Canada, J4Z 1M6

[21] Appl. No.: 714,000

[22] Filed: Sep. 18, 1996

[51] Int. Cl.[6] ..... F23C 5/00

[52] U.S. Cl. ..... 431/8; 431/118; 431/264; 431/330; 239/433

[58] Field of Search ..... 431/8, 117, 118, 431/264, 330; 239/426, 434, 120, 433

[56] References Cited

U.S. PATENT DOCUMENTS

| | | | |
|---|---|---|---|
| 3,425,058 | 1/1969 | Babington | 431/117 |
| 4,431,382 | 2/1984 | Edman et al. | 431/118 |
| 4,573,904 | 3/1986 | Babington | 431/117 |

*Primary Examiner*—Carroll B. Dority
*Attorney, Agent, or Firm*—Eric Fincham

[57] ABSTRACT

A liquid fuel burner apparatus which comprises a fuel distributing member of a generally conical configuration mounted within a housing, along with means for feeding a liquid fuel to an upper end of the fuel distributing member to allow the liquid fuel to form a film on the outer surface. A vaporizing aperture is formed in the outer surface and a gas supply conduit supplied with a pressurized gaseous material to atomize the fuel for ignition. The unburned fuel is then collected and recycled back to the burner. The apparatus permits the burning of material which may contain small particles which would otherwise clog the nozzle of a conventional apparatus.

12 Claims, 2 Drawing Sheets

LIQUID FUEL BURNERS

FIELD OF THE INVENTION

The present invention relates to an apparatus and method for burning a fuel.

BACKGROUND OF THE INVENTION

The use of different types of fuel nozzles is well known in the art. Typically, a fuel nozzle has a means of supplying a liquid fuel through an opening with or without coaxial flow of a gas. The main purpose of the nozzle is delivery of the liquid fuel to the desired location along with achieving a desired degree of atomization of the liquid.

In most instances, a fuel nozzle can be designed for maximum efficiency for a given type of fuel. However, a problem arises when the fuel contains contaminants. Such contaminants can range from water or other non volatile liquids to particulate matter. In such instances, a conventional nozzle does not function efficiently and indeed, blockage frequently will occur.

There are many situations where it would be desirable to burn contaminated liquids. For example, the problem of proper disposal of used engine oil is one which has received a great deal of attention. In the past, oils were frequently dumped and caused environmental pollution. In many areas, it is now required by law that these engine oils be recycled or otherwise disposed of in an environmentally friendly manner.

One solution to the problem of disposal of used engine or motor oil would be the burning of the same to recover the heat value therein. However, conventional nozzle assemblies and/or burner arrangements do not suffice to burn such liquids which may contain many different contaminants.

One type of apparatus which has been proposed in the art for delivering liquid for use in fuel burners or atomizers is shown in U.S. Pat. No. 4,573,904 to Babington. The Patentee therein refers to the "Babington principle" of preparing a liquid for atomization by causing it to spread out in a free flowing thin film over the exterior surface of a plenum having an exterior wall which defines an atomizer bulb and contains an aperture. When gas is introduced into the plenum, it escapes through the aperture and thereby creates a very uniform spray of small liquid particles. This general arrangement does not suffer from the same problems inherent in nozzle assemblies and is generally more suitable for burning liquids having contaminants. However, various practical problems appear to arise in the practice of these inventions including the proper control of the atomization and control of the flame so as not to destroy components of the burner.

SUMMARY OF THE INVENTION

It is an object of the present invention to provide for a fuel burner which has a efficient fuel delivery system.

It is a further object of the present invention to provide a fuel burner wherein a controlled burn of a liquid fuel may be achieved.

It is a further objection of the present invention to provide for a novel atomization device.

It is a still further objection of the present invention to provide for a method for disposing of used engine oil.

It is a further object of the present invention to provide a fuel delivery system and burner apparatus for the efficient combustion of liquid fuels.

According to one aspect of the present invention, there is provided a liquid fuel burner apparatus which comprises a housing having a fuel distributing member mounted within. The fuel distributor member is of a generally conical configuration having a narrower upper end and a wider portion downwardly thereof. There are provided means for feeding a liquid fuel to the upper end of the fuel distributing member to allow the liquid fuel to form a film on an outer surface of the fuel distributing member. A vaporizing aperture is formed in the outer surface of the conically shaped member with a gas supply conduit providing fluid communication to the aperture to permit atomization of the fuel. Ignition means are provided to ignite the atomized fuel. There are also means to collect the unburned fuel from the fuel distributing member.

In a further aspect of the invention, there is provided a method of burning a liquid fuel having contaminants therein and which comprises the step of supplying an apparatus having a fuel distributing member with a generally conical configuration, the fuel distributing member having a narrower upper end and a wider portion downwardly thereof, and a vaporizing aperture formed in an exterior wall of the conically shaped member. That includes the step of feeding a liquid fuel to an upper portion of the fuel distributing member to allow a liquid film to flow downwardly therefrom and feeding a pressurized gas to the vaporizing aperture to thereby cause atomization of the liquid fuel at the aperture. Subsequently, there is the step of igniting the atomized fuel and controlling the distance between a source of ignition and the vaporizing aperture.

In a still further aspect of the invention, in a liquid fuel burner apparatus wherein there is provided a fuel distributing member and means for feeding liquid fuel to the fuel distributing member to allow a film of liquid fuel to form on a an outer surface thereof, an aperture being formed in the outer surface and means for supplying a pressurized gas to the aperture to atomize the liquid fuel, there is provided the improvement wherein the fuel distributing member comprises a generally solid member formed of a metallic material and having an overall generally conical configuration, the means for supplying fuel being located adjacent an upper narrower section of the fuel distributing member.

In greater detail, the apparatus and method are designed for burning a liquid fuel and are particularly suitable for a liquid fuel having contaminants therein which might tend to otherwise block a nozzle. One such fuel would, by way of example, be used engine oil from vehicles.

The fuel distributing member is mounted within a housing, and which housing may be any suitable. The fuel distributor member is of a generally conical configuration having a narrower upward end and a wider base. In this respect, it will be understood that the operative portion of the fuel distributing member is of the conical configuration; other portions may be added thereto as will be shown in the preferred embodiments hereof.

Means are provided for feeding a liquid fuel to the upper end of the fuel distributing member to thereby allow the liquid fuel to form a thin film on an outer surface of the member. Although different methods may be employed, a preferred one is the use of a feed pipe which has a control spacing from the upper end of the fuel distributing member.

Spaced downwardly from the narrower upward end is an aperture which is formed in the outer surface of the fuel distributing member and which is connected to a gas by conduit. The arrangement is such that fuel reaching the aperture is subjected to the blast of the gas to thereby atomize the fuel. As will be appreciated, the aperture can be of various different configurations although a generally slot like aperture may conveniently be used.

The remaining fuel which is not atomized will continue downwardly where it may be collected in a sump and then returned via suitable conduits and pumps to be re-fed to the fuel distributing member. In this respect, the sump or conduits associated therewith preferably include a trap to prevent the ingress of air.

The fuel distributing member is advantageously formed of a solid metallic material so as to provide a heat sink which can act to heat the fuel on the surface thereof. Also, means are preferably provided for moving the fuel distributing member so as to control its distance relative to means for igniting the fuel.

The means for igniting the fuel may comprise a suitable electrode as is known in the art.

Having thus generally described the invention, reference will be made to the accompanying drawings illustrating an embodiment thereof, in which:

DESCRIPTION OF THE PREFERRED EMBODIMENTS

Figure 1:
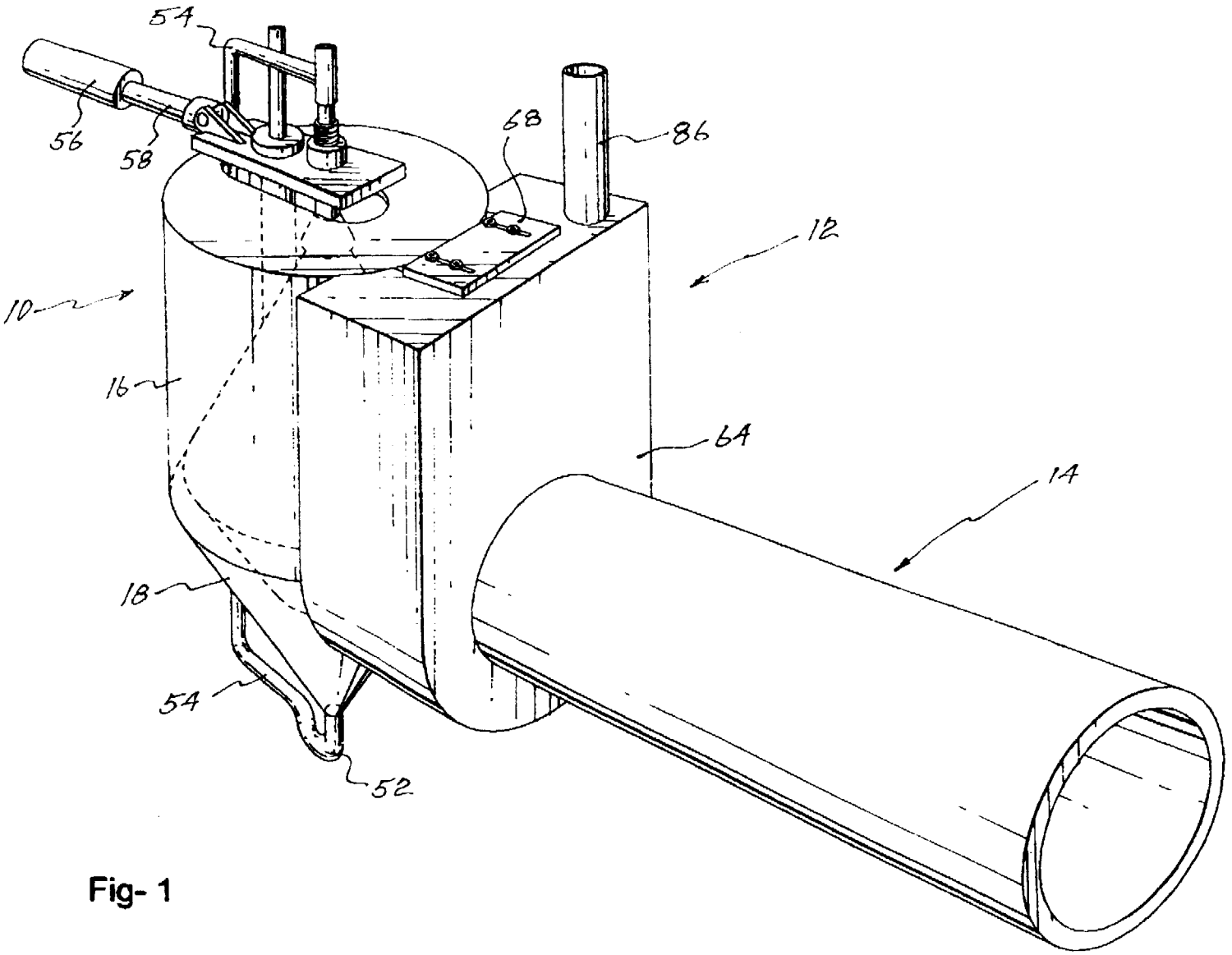
FIG. 1 is a perspective view of a fuel burning apparatus according to the present invention.
Figure 2:
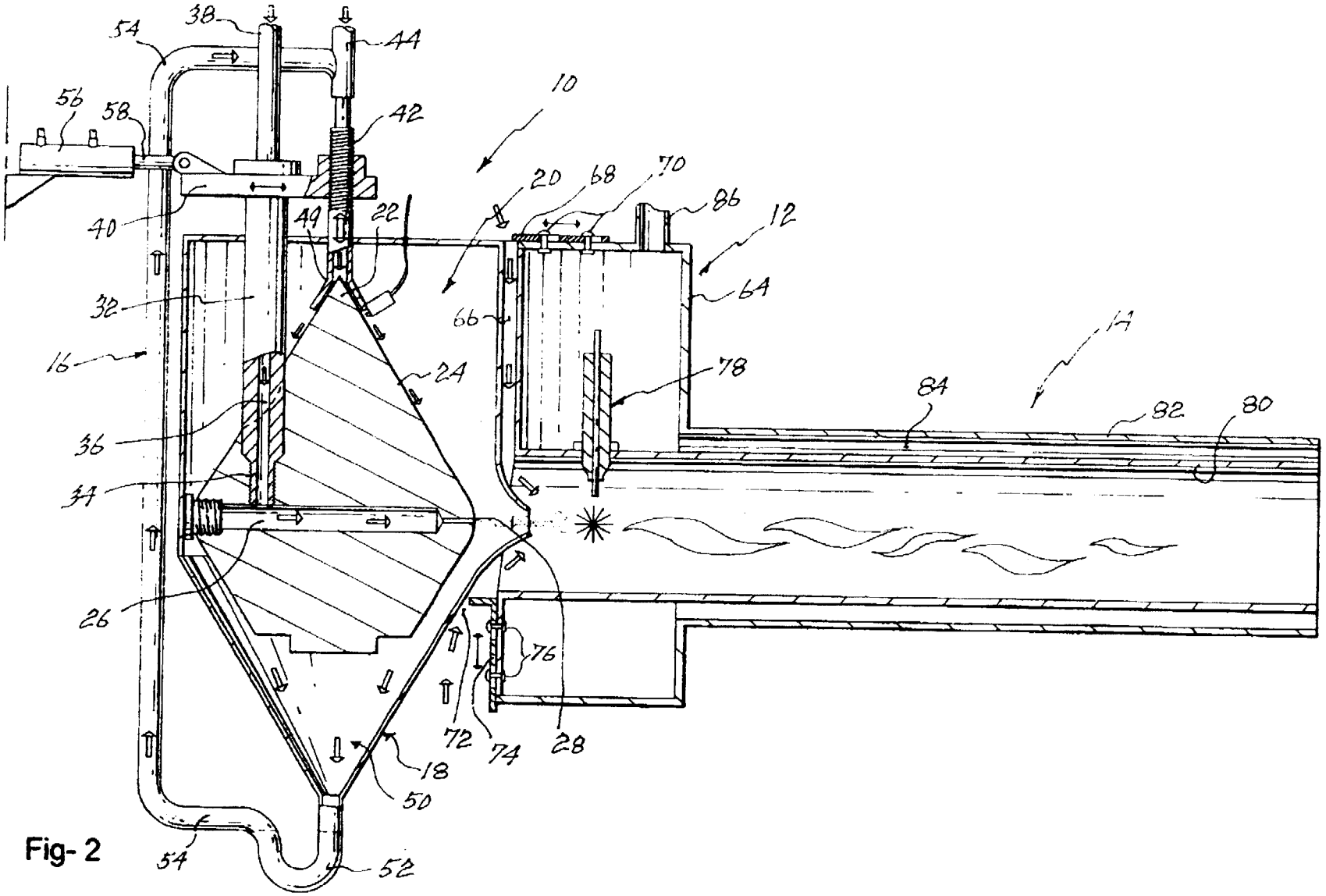
FIG. 2 is a side sectional view thereof.

Referring to the drawings in greater detail and by reference characters thereto, the apparatus shown in the Figures includes a fuel distribution module 10, an ignition module 12 and an exit pipe 14.

Fuel distribution module 10 has an upper generally cylindrical housing 16 and a lower funnel shaped housing 18.

Mounted interiorly of the housing is a fuel distributing member generally indicated by reference numeral 20. Member 20 has an upper portion thereof which is of a conical configuration including an upper end or apex 22 with an exterior wall 24 tapering outwardly and downwardly.

Member 20 is preferably formed of a solid metallic material and has a conduit 26 formed interiorly thereof. Conduit 20 feeds an atomizing slot 28 formed in wall 24. Member 20 also has a lower portion 30 formed below conduit 26 and atomizing slot 28.

Fuel distributing member 20 is supported by a support 32 having a threaded portion 34 screw threadedly engaged in member 20. Interiorly of support 32 there is provided a conduit 36 which is in fluid communication with conduit 26. In turn, a gas supply tube 38 is in fluid communication with conduit 36. Support 32 is mounted in a bracket generally indicated by reference numeral 40.

The fuel delivery tube 42 has a T-shaped connector 44 associated therewith. Delivery tube 42 is in fluid communication with a delivery duct 46 which is adjustably connected to bracket 40. Duct 46 passes through housing 16 and has an inverted funnel shaped outlet 49 which is mounted about apex 22 of fuel distributing member 20.

Lower housing 18 forms a sump for collecting unburnt fuel as will be explained hereinbelow. Sump 50 is connected to a fuel return line 54 having a trap 52 incorporated therein.

It will be noted that bracket 40 is connected to a cylinder 56 by means of a piston 58 for reciprocal movement in the longitudinal direction.

Ignition module 12 includes a housing 64 which, in conjunction with upper cylindrical housing 16 forms an upper duct 66 therebetween. Entry to upper duct 66 is controlled by a plate member 68 which is secured to housing 64 by means of bolts 70.

A lower duct 72 is formed between housing 64 and lower housing 18 of fuel distribution module 10. An L-shaped element 74 is secured to housing 64 by means of bolts 76 to control the entry of secondary combustion air through lower duct 72.

An electrode 78 is provided for igniting the fuel air mixture as will be discussed hereinbelow.

Exit pipe 14 includes an inner tube 80 and a coaxial outer tube 82 with an air space 84 intermediate thereof. An air inlet 86 is provided to permit air entry into air space 84 through ignition module 12.

In operation, fuel is fed through tube 42 and delivery duct 46 to apex 22 of fuel distributing member 20. The amount of fuel delivered can be controlled by the spacing between inverted funnel shaped portion 49 and apex 22. Thus, the reciprocal adjustment as indicated by arrow 88 controls the amount of fuel fed to fuel distributing member 20.

On fuel distributing member 20, the fuel forms a thin layer on outer surface 24. Due to its conical configuration, the fuel is fed in a thin film. Meanwhile, a suitable gas such as air is fed from conduit 36 to conduit 26 and thence to atomizing slot 28.

Electrode 78 is adapted to ignite the atomized fuel and in this respect, it will be noted that secondary combustion air can be supplied through ducts 66 and 72. The amount of secondary combustion air can be controlled.

Due to the extremely high temperatures, air can be fed through air inlet 86 to air space 84 to provide a cooling for the exit pipe 14.

It will be understood that the above described embodiment is for purposes of illustration only and that changes and modifications may be made thereto without departing from the spirit and scope of the invention.

I claim:

1. A liquid fuel burner apparatus, said apparatus comprising a housing, a fuel distributing member mounted within said housing, said fuel distributing member having a generally conical configuration, with a narrower upper end and a wider portion downwardly thereof, means for feeding a liquid fuel to said upper end of said fuel distributing member to allow said liquid fuel to form a film on an outer surface thereof, a vaporizing aperture formed in said outer surface of said conically shaped member, a gas supply conduit providing fluid communication to said aperture to permit atomization of said fuel, ignition means operatively located to ignite said atomized fuel, and means to collect unburnt fuel from said fuel distributing member.

2. The apparatus of claim 1 further including a sump to collect unburnt fuel from said fuel distributing member, means to return said unburnt fuel to said feeding means, and a liquid trap between said sump and said means to return said unburnt fuel.

3. The apparatus of claim 1 wherein said fuel distributing member is formed of a solid metallic material.

4. The apparatus of claim 3 wherein said material is brass.

5. The apparatus of claim 1 further including means for moving said fuel distributing member so as to vary a distance between said fuel distributing member and said ignition means.

6. The apparatus of claim 1 further including means for providing a controlled supply of secondary combustion air adjacent to said ignition means.

7. The apparatus of claim 1 further including an exit pipe to receive products of combustion, said exit pipe including an air shell thereabout for cooling.

8. The apparatus of claim 1 wherein said means for feeding a liquid fuel to an upper portion of said fuel distributing member comprises a cylindrical feed pipe placed over said upper portion of said fuel distributing member and means to vary the distance between said pipe and said fuel distributing member.

9. A method of burning a liquid fuel having contaminants therein, the method comprising the step of supplying an apparatus having a fuel distributing member, the fuel distributing member having a generally conical configuration with a narrow upper portion and a wider portion downwardly thereof, a vaporizing aperture formed in an exterior wall of said conically shaped member, feeding a liquid fuel to said upper portion of said fuel distributing member to allow a thin liquid film to flow downwardly from said upper portion, feeding a pressurized gas to said vaporizing aperture to thereby cause atomization of the liquid fuel at said aperture, igniting said atomized fuel, and controlling the distance between a source of ignition and said vaporizing aperture.

10. In a liquid fuel burner apparatus wherein there is provided a fuel distributing member, means for feeding a liquid fuel to said fuel distributing member to allow a film of liquid fuel to form on an outer surface thereof, an aperture formed in the outer surface, means for supplying a pressurized gas to said aperture to atomize said liquid fuel, the improvement wherein said fuel distributing member comprises a generally solid member formed of a metallic material, said member having an overall generally conical configuration, said means for supplying fuel being located adjacent an upper narrower section of said fuel distributing member.

11. The apparatus of claim 6 further including means for controlling said supply of secondary combustion air.

12. The method of claim 9 further including the step of providing a supply of secondary combustion air adjacent said source of ignition.

* * * * *